United States Patent [19]

Belanger et al.

[11] Patent Number: 4,552,297

[45] Date of Patent: Nov. 12, 1985

[54] ROTATABLE RELOADING APPARATUS FOR A STAPLER

[75] Inventors: James A. Belanger, Northville; Douglas J. Calvin, Farmington Hills; Brian K. Thompson, Wixom, all of Mich.

[73] Assignee: Belanger, Inc., Northville, Mich.

[21] Appl. No.: 516,033

[22] Filed: Jul. 22, 1983

[51] Int. Cl.[4] ..... B25C 1/04; B25C 5/02; B21J 15/28

[52] U.S. Cl. ..... 227/120; 227/8; 227/125; 227/130; 227/152; 227/153; 227/155

[58] Field of Search ..... 227/120, 130, 152, 153, 227/155, 8, 125

[56] References Cited

U.S. PATENT DOCUMENTS

| | | | |
|---|---|---|---|
| 2,170,468 | 8/1939 | Blackmon | 227/120 X |
| 2,368,552 | 1/1945 | La Place | 227/120 |
| 2,771,609 | 11/1956 | Klopstock | 227/120 X |
| 3,198,412 | 8/1965 | Roosa | 227/8 |
| 3,489,328 | 1/1970 | Martin | 227/7 |
| 3,604,608 | 9/1971 | Mullaney | 227/120 |
| 4,091,981 | 5/1978 | Moriguchi et al. | 227/8 |
| 4,197,974 | 4/1980 | Morton et al. | 227/8 |

FOREIGN PATENT DOCUMENTS

| | | | |
|---|---|---|---|
| 1171355 | 5/1964 | Fed. Rep. of Germany | 227/120 |
| 2024084 | 1/1980 | United Kingdom | 227/120 |

OTHER PUBLICATIONS

Xerox Disclosure Journal, vol. 4, No. 5, Sep./Oct. 1979, pp. 597–599.

*Primary Examiner*—Paul A. Bell
*Assistant Examiner*—Taylor J. Ross
*Attorney, Agent, or Firm*—Cullen, Sloman, Cantor, Grauer Scott & Rutherford

[57] ABSTRACT

A reloading apparatus for automatically supplying staples to a stapler. A supply of staples is retained on a plurality of rails which are fixed to a cylindrical support member which is rotatably mounted on a common frame with the stapler. The staples are sequentially fed from the rails of the reloading apparatus to the stapler by a pneumatically powered follower which moves toward the stapler on a feeding stroke and returns to the opposite side of the rails after the staples on a rail have been fed into the stapler. An indexer then rotates the cylindrical support to align another rail with the follower to feed the staples on the other rail into the stapler. A pneumatic control coordinates the stapler and the reloading apparatus.

6 Claims, 7 Drawing Figures

ROTATABLE RELOADING APPARATUS FOR A STAPLER

BACKGROUND OF THE INVENTION

1. Technical Field

The present invention relates to a power stapler having an automatic reloading apparatus and more specifically to a reloading apparatus having a plurality of rails for retaining a supply of staples with the staples on each rail being sequentially loaded into the stapler.

2. Prior Art

Staplers used in production applications are preferably high speed devices that use a large quantity of staples in a short time. Staples generally are supplied to a stapler in strips wherein a plurality of staples are aligned and held together by a binder. Staplers using strips of staples are dependable and resist jamming because the staples support one another in the proper orientation until the stapler drives each staple into engagement with the workpiece.

One disadvantage of staplers using staples in the strip form is that workers are required to manually replace the strips of staples as they are used by the stapler. Generally an operator will reload the stapler when he finds that the supply of staples is depleted. The operator then partially disassembles the stapler removing the follower block and then inserts a new strip of staples into the stapler magazine before replacing the follower block. The reloading operation interrupts production and reduces the productivity of the production operation.

U.S. Pat. No. 3,174,672 to Julifs discloses one such production stapler having an improved magazine which is loaded from the rear end. The stapler may be loaded without removing any parts from the magazine to load a new strip of staples into the stapler. The stapler does not require the feeder to be cocked before the staples are inserted and the magazine may be loaded and cocked in a single motion. While the Julifs device reduces the amount of time and effort required to reload a stapler, the operator must still feed strips of staples into the stapler individually which requires the operator to stop his production, locate the strip of staples and insert it into the stapler magazine.

These and other problems encountered by prior art devices have been overcome by the reloading apparatus of the present invention.

SUMMARY OF THE INVENTION

In accordance with the invention, an improved stapler reloading apparatus having a revolver-type reloading magazine with a plurality of rails fixed to a support is provided which permits automatic reloading of a stapler. The stapler is reloaded without requiring the operator to interrupt his production routine which thereby improves production.

The present invention realizes all the advantages of prior art staplers which use strips of staples. The advantages being that such devices are dependable, high production machines which are resistant to jamming.

The reloading apparatus of the present invention may be retrofit onto existing rear loading staplers. Thus, existing staples may be converted from manual reloading to automatic reloading by adapting the staplers to receive the automatic reloading apparatus of the present invention.

The reloading apparatus is preferably pneumatically powered and controlled and is interfaced with the pneumatic circuit of the stapler. In one embodiment of the present invention, a power anvil is also included which moves in opposition to the primary stapler drive to clamp the workpiece firmly in position in the stapler. The power anvil retracts to permit loading and unloading of workpieces.

BRIEF DESCRIPTION OF THE DRAWINGS

Other objects and advantages of the invention will become apparent upon reading the following detailed description with reference to the drawings, in which.

DETAILED DESCRIPTION OF THE INVENTION

Figure 1:
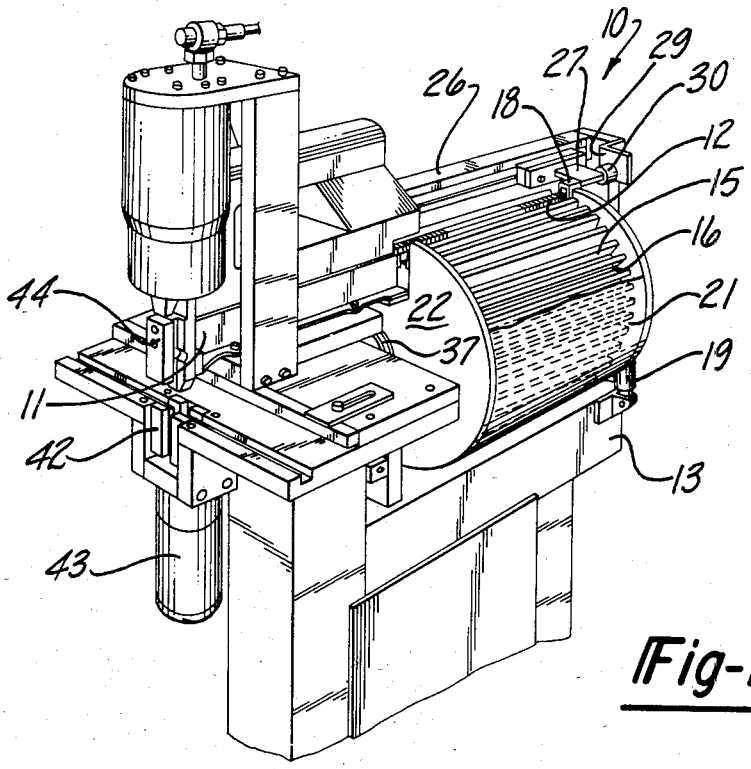
FIG. 1 is a perspective view of a stapler with the reloading apparatus of the present invention attached thereto.

Turning first to FIG. 1, the reloading apparatus 10 of the present invention is shown attached to a stapler or fastening device 11 which is pneumatically operated. The reloading apparatus 10 includes a fastener storage unit which is used to introduce staples or fasteners 12 in strip form into the magazine 17 of the stapler 11. The reloading apparatus 10 and stapler 11 are both secured to a common frame member 13. The reloading apparatus 10 includes a pluraity of rails 15 which are affixed to a cylindrical support, hub or hub structure 16. The cylindrical support 16 has a central axis X with which the rails 15 are aligned in parallel. The reloading apparatus 10 includes a follower or pusher member 18 for advancing the staples on a given rail 15 in the reloading apparatus into the stapler 11. An indexer 19 is also provided for rotating the cylindrical support 16 to align another rail 15 with the stapler 11.

The reloading appartus 10 shown in the disclosed embodiment is adapted to be used with a rear loaded power stapler 11. For example and not by way of limitation, a Senco Model M-I pnuematic stapler may be simply adapted for use with the reloading apparatus by cutting away a portion of the rear of the stapler housing.

Figure 5:
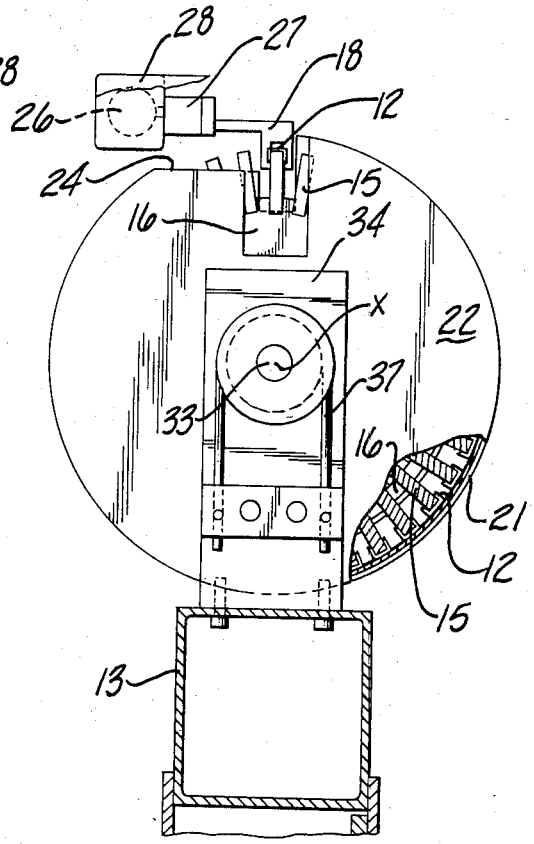
FIG. 5 is a cross-sectional view of the reloading apparatus taken along the line 5—5 in FIG. 2.
Figure 6:
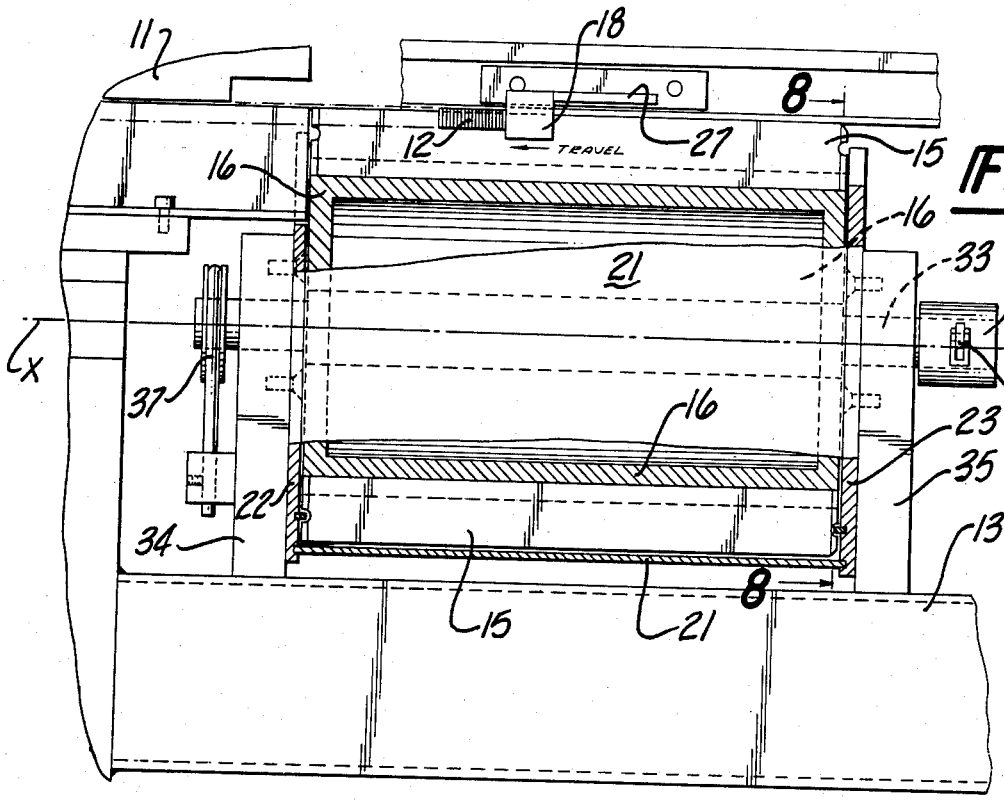
FIG. 6 is a side elevational view of the reloading apparatus taken along the line 6—6 in FIG. 4.

The reloading apparatus 10 is partially enclosed by a cylindrical housing 21 which extends around the outside of the rails 15 in a closely spaced relationship therewith to hold the staples 12 on the rails 15 when the rails are positioned to extend downwardly from the cylindrical support 16. As best shown in FIG. 5, the staples 12 are held on the rails 15 by riding against the inside surface of the cylindrical housing 21 with the legs of the staples 12 being located on opposite sides of the rails 15.

Figure 4:
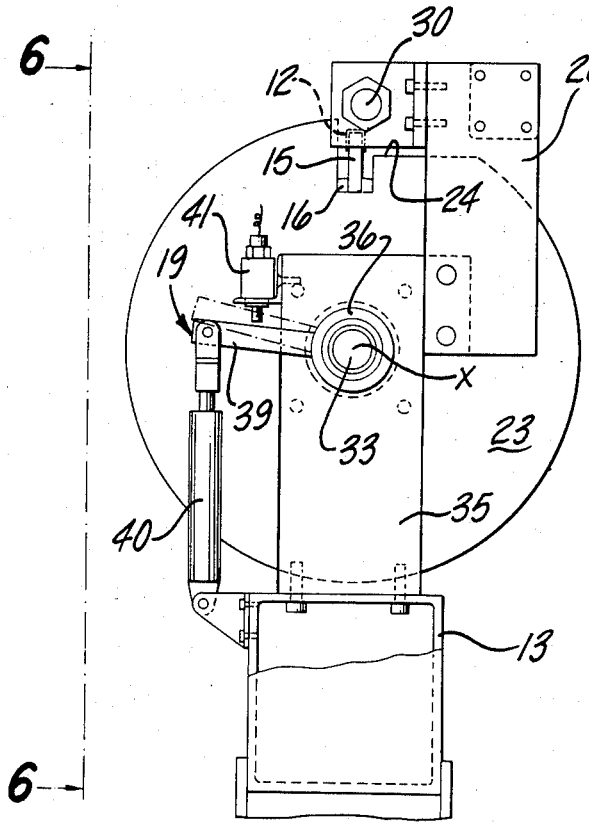
FIG. 4 is a rear view of the reloading apparatus taken along the line 4—4 in FIG. 2.

The rails 15 and cylindrical support 16 are further enclosed by the front and rear end plates 22 and 23 which are attached to opposite ends of the cylindrical housing 21. An access opening 24 is formed in the top of the cylindrical housing 21 and extends into corresponding portions of the front and rear end plates 22 and 23 to permit the follower 18 to engage a rail 15 and load staples 12 into the magazine 17 of the stapler 11. As shown in FIGS. 4 and 5, the access opening 24 on the front and rear end plates 22 and 23 also includes an L-shaped cutout in the top of the end plates.

Figure 2:
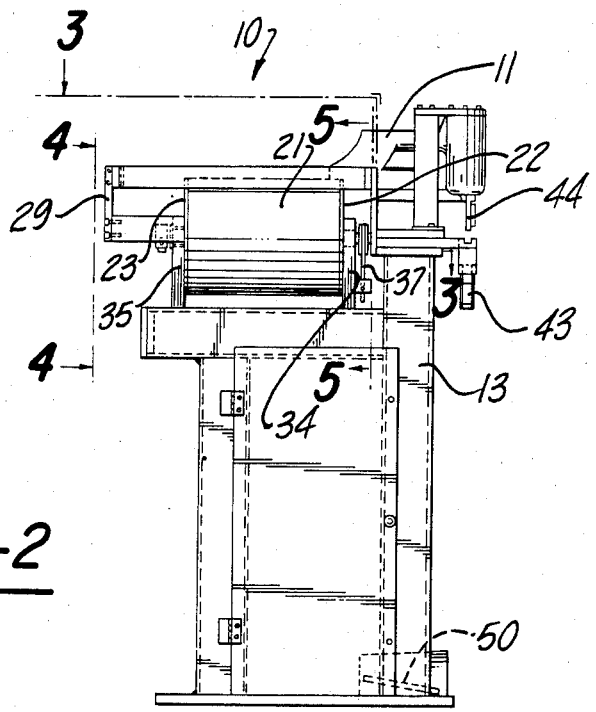
FIG. 2 is a side elevational view of the stapler and reloading apparatus mounted on a common frame.
Figure 3:
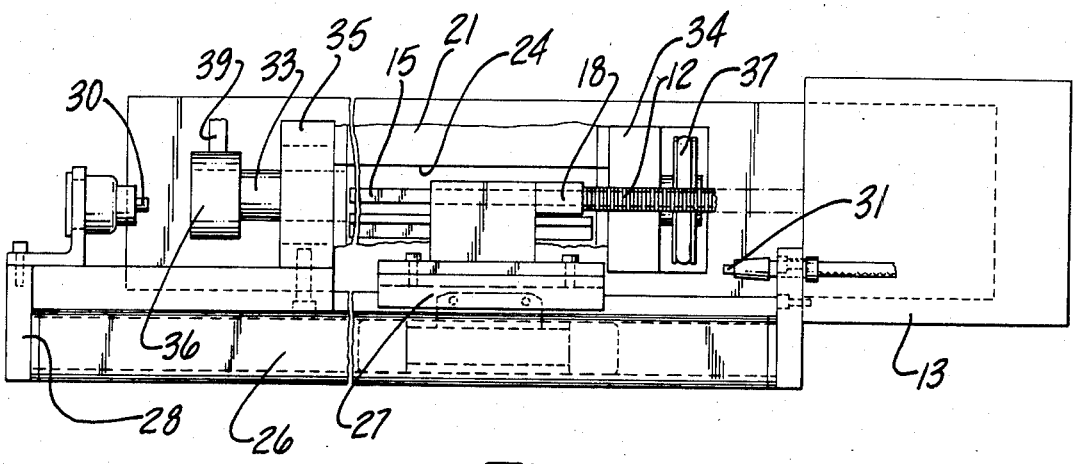
FIG. 3 is a cross-sectional view taken along the line 3—3 in FIG. 2 showing the top of the reloading apparatus.

The follower 18 is powered by a pneumatic cylinder 26 which is connected to the follower block 29 by means of a follower retainer 27. As shown in FIGS. 1, 2 and 3, the pneumatic cylinder 26 is attached to the frame 13 by means of a bracket 28 which extends from behind the rear end plate 23 the length of the cylindrical housing 21 to a point in front of the front end plate 22. The follower block 29 is moved by the pneumatic cylinder 26 in a linear path following the surface of the rail 15.

The follower 18 is controlled by rear and front limit switches 30 and 31 which are mounted on the bracket 28. The front limit switch is referred to as the first limit switch and the rear switch is referred to as the second limit switch. The follower retainer 27 is advanced by the pneumatic cylinder 26 toward the stapler 11 until it contacts the front limit switch 31 which causes the cylinder 26 to drive the follower block 29 away from the stapler 11 as will be described subsequently. The front limit switch 31 is positioned so that the follower retainer 27 will contact the limit switch 31 at the same time that all of the staples 12 on a rail 15 have been expended. The switch 31 is contacted upon completion of the feeding or loading stroke by the follower or pusher member 18. As a result thereof the return stroke of the follower or pusher member 18 is initiated.

The pneumatic cylinder 26 then drives the follower block 29 away from the stapler 11 until the follower retainer 27 or follower block 29 contacts the rear limit switch 30. The rear limit switch 30 is positioned so that when the follower block 29 is clear of the rail 15 the cylindrical support 16 may be rotated without interference from the follower block 29. Upon contacting the rear limit switch 30 the control system activates the indexer 19 and changes the direction of movement of the pneumatic cylinder 26 as will be described subsequently in reference to the control portion of the apparatus 10.

The cylindrical support 16 is rotatably mounted on a shaft 33 which is in turn journalled on front and rear shaft supports 34 and 35 which are located adjacent the front and rear end plates 22 and 23. One way movement of the shaft 33 is permitted by a ratchet 36, or one way clutch, which is mounted on the shaft 33 adjacent the rear shaft support 35. A brake 37 is mounted on the shaft 33 adjacent the front shaft support 34 to limit the rotational movement of the cylindrical support 16. In the disclosed embodiment the brake 37 comprises a leather strap which is wound around a pulley. However, it should be understood that many other types of brakes may be used in accordance with the present invention or, alternatively, a spring tension mechanism would also be suitable.

The indexer 19 rotates the cylindrical support 16 to change which rail 15 is aligned with the magazine 17 of the stapler 11. The movement of the cylindrical support 16 is a rotational movement similar to the movement of a revolver. The indexer 19 includes an arm 39 which is secured to the ratchet 36 to extend radially therefrom. A pneumatic cylinder 40 is connected to the frame 13 and the end of the arm 39 to move the arm 39 in a short arcuate path as shown in FIG. 4. In the preferred embodiment, the cylinder 40 extends to lift the arm 39 which rotates the ratchet 36 until the arm 39 contacts the index limit switch 41. Upon contacting the index limit switch 41 the movement of the pneumatic cylinder 40 is reversed to retract the arm 39 to its original position as shown in solid lines in FIG. 4. When the pneumatic cylinder 40 retracts, the ratchet 36 disengages the shaft 33 to permit the shaft to remain in its shifted position.

The stapler 11 of the present invention includes a clamping anvil 42 which is powered by pneumatic clamp cylinder 43 to clamp a workpiece into engagement with the ram 44 of the stapler 11. After the staple 12 has been inserted in the workpiece the anvil 42 retracts to provide a clearance for removal of the workpiece and insertion of a subsequent workpiece. The clamping anvil 42 of the present invention is especially useful in fastening a plurality of sheets together as a unit. The clamping force exerted by the anvil 42 squeezes the sheets so that a staple 12 may be driven into the sheets to hold them together tightly.

Figure 7:
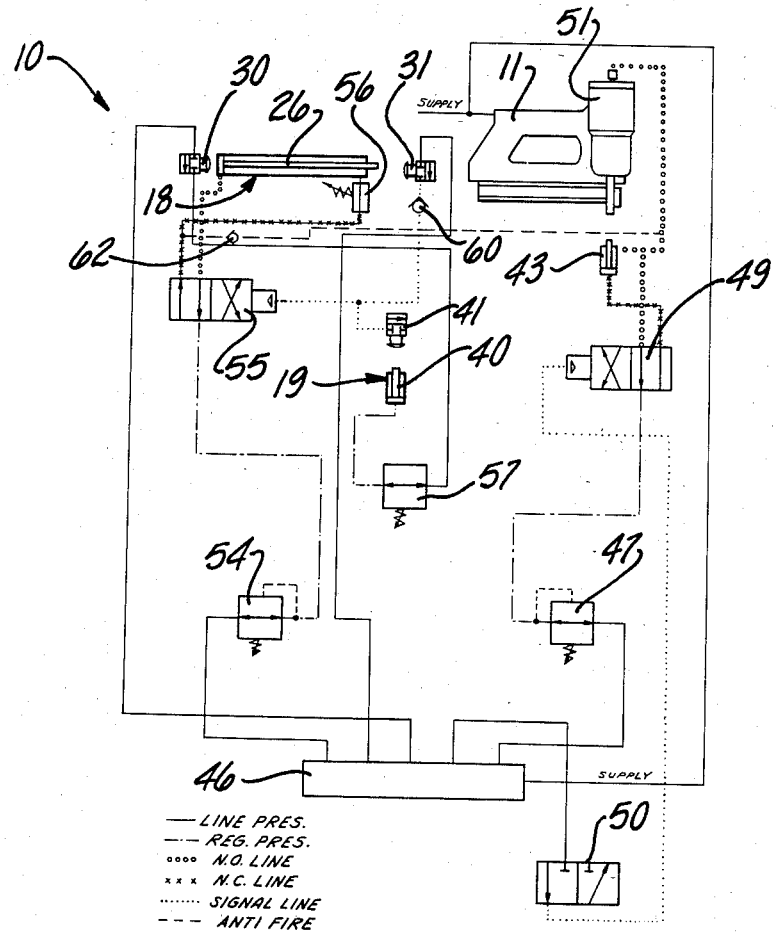
FIG. 7 is a pneumatic diagram of the stapler and reloading apparatus control and drive system.

In accordance with a further aspect of the invention, the unique control system shown in the pneumatic control diagram of FIG. 7 sequences the operation of the stapler 11, follower 18 and indexer 19. The reloading apparatus 10 and stapler 11 are powered and controlled by a single pneumatic system including a manifold 46 which receives pressurized air from a supply source (not shown). In a first circuit, the manifold 46 is connected through a pressure regulator 47 to a two position, four-way valve 49 which operates the pneumatic clamp cylinder anvil 43 and staple drive 51 of the stapler 11. The four-way valve 49 in its nonenergized position provides pressurized air to the anvil cylinder 43 to urge the anvil 42 towards the retracted position and the return side (not shown) of the staple drive 51. The stapler 11 is controlled by the foot peddle valve 50 which may be operated to shift the four-way valve 49 to its operative position wherein pressurized air is supplied to the anvil cylinder 43 and the staple drive 51 to clamp the workpiece between the anvil 42 and the staple drive 51 for driving a staple 12 through the workpiece.

The follower 18 is connected to the manifold 46 through the pressure regulator 54 and the two position, four-way valve 55. The four-way valve 55 has a normal position shown with parallel lines wherein the pneumatic cylinder 26 is driven by pressurized air from left to right as shown in FIG. 7. As the pneumatic cylinder 26 is moved from left to right staples 12 are being fed from the rail 15 of the reloading apparatus 10 to the stapler 11. The amount of air pressure supplied to the pneumatic cylinder 26 in the advancing motion is controlled by pressure regulator 56 in the line which exhausts air from the pneumatic cylinder 26. Movement from left to right is stopped as previously described when the follower retainer 27 contacts the front limit switch 31.

The limit switch 31 is then shifted to permit air to flow from the manifold through the normally closed index limit switch 41 to the shifting mechanism of the four-way valve 55. When this occurs the four-way valve 55 shifts to its crossover orientation which pressurizes the return side of the pneumatic cylinder 26 to drive the cylinder 26 from right to left as viewed in FIG. 7. Retraction of the pneumatic cylinder 26 continues until the follower retainer 27 contacts the rear limit switch 30.

When the rear limit switch 30 is contacted it connects the manifold 46 with the pneumatic cylinder 40 of the indexer 19 through the pressure regulator 57. The pneumatic cylinder 40 moves the arm 39 until the index limit switch 41 is contacted. The index limit switch 41 interrupts the air flow to the four-way valve 55 shifting mechanism which causes the four-way valve 55 to return to the initial position shown in FIG. 7 in which the pressurized air from pressure regulator 54 is supplied to the left side of the pneumatic cylinder 26.

The reloading apparatus 10 and stapler 11 are interconnected for disabling the stapler 11 while the reloading apparatus 10 is shifting the follower 18 back to the index position and while the indexer 19 is shifting from one rail 15 to another rail 15. When the four-way valve 55 is in the shifted position pressurized air from the pressure regulator 54 is shunted through the check valve 62 to the return side of the staple drive 51 and the retraction side of the anvil cylinder 43. This air pressure should be greater than the pressure received from the pressure regulator 47 so that operating the foot peddle 50 will not activate the stapler 11.

The reloading apparatus 10 must be periodically filled with strips of staples 12. This is done by stopping the follower 18 when the follower block 29 is clear of the rail 15. Strips of staples 12 can then be inserted onto the rails 15 through the access opening 24. As the rails 15 which are accessible through the access opening 24 are filled, the cylindrical support 16 is rotated to continue the procedure. Depending upon the number and length of the rails 15, a large quantity of staples 12 can be supplied to the stapler 11 at one time, such as at the beginning of a shift, so that production interruptions are minimized.

The foregoing is a complete description of a preferred embodiment of the present invention. Various changes and modifications may be made without departing from the spirit and scope of the present invention. The actual invention, therefore, should be limited only by the scope of the following claims.

What is claimed is:

1. A reloading apparatus in combination with a magazine and a pneumatically operated fastening device, with said reloading apparatus effective to supply fasteners to said magazine for said fastening device comprising:

a frame;

a fastener storage unit for supplying fasteners to be loaded into said magazine mounted on said frame;

said fastener storage unit including a plurality of rails adapted to receive the fasteners fixed to a support rotatably mounted on said frame having a central axis about which said rails rotate with each rail being aligned parallel to the central axis;

a pneumatically operated pusher member in operative communication with said storage unit pushing fasteners toward said magazine until contacting a first limit switch on a loading stroke, returning from said magazine to retrieve additional staples on a return stroke until contacting a second limit switch;

a two-way switching means controlling said pusher member operatively responding to said first and second limit switches;

indexer means operably attached to said support for rotating said support incrementally and positioning another of said rails relative to said pusher member;

said indexer means including a hub secured to said supprot coaxial with the central axis of said support;

a one-way clutch secured to said hub;

an arm connected to the clutch and extending radially outwardly from the clutch;

a pneumatic cylinder attached to the frame and operably connected to the arm for arcuately pivoting the arm about the central axis;

said pneumatic cylinder being actuated by said second limit switch when said second limit switch is contacted by said pusher member on the return stroke;

a third limit switch adapted to be engaged after the arm has pivoted a predetermined amount to cause the pneumatic cylinder to pivot the arm in the opposite direction about the central axis; and a shunting means connecting said two-way switching means with said pneumatically operated fastening device thereby preventing the latter from operating when said pusher member is in the return stroke.

2. The reloading apparatus and combination of claim 1, wherein said plurality of rails are sequentially aligned with said magazine.

3. The reloading apparatus and combination of claim 1, wherein the fasteners comprise a plurality of staples held together by a bonding material.

4. The reloading apparatus and combination of claim 1, wherein said switching means, pusher member, and indexer means are pneumatically powered by one single pneumatic circuit.

5. A reloading apparatus for a stapler having a magazine through which staples are dispensed comprising;

a frame;

an elongated shaft having an axis;

a pair of axially spaced shaft supports carried by said frame;

said shaft extending between and through openings provided in said supports, said shaft supports mounting said shaft for rotation;

a generally cylindrical hub structure rotatably mounted on said shaft and located between said shaft supports;

a plurality of rails having first and second ends fixed to and rotatable with said hub structure, said rails being spaced from said axis and extending parallel thereto;

said rails being adapted to receive staples thereon;

reciprocal follower block located at said first end of one of said rails engageable with the staples on said one rail to move the staples towards said second end of said rail for feeding the staples into the magazine of the stapler during a feeding stroke, thereafter returning to said first end of said one rail on a return stroke;

a first limit switch adapted to be engaged when said follower block reaches said second end of one of said rails stopping said feeding stroke and initiating said return stroke;

a second limit switch adapted to be engaged when said follower block reaches said first end of said one rail stopping said return stroke;

a pneumatic cylinder mounted on said frame connected to said follower block for reciprocating said follower block between said first and second ends; and indexer means located between said frame and said cylindrical hub structure for rotating said hub structure in increments about said axis to position another rail relative to said follower block;

said indexer means comprises; a one-way clutch secured to said hub structure;

an arm connected to said clutch and extending radially outward from said clutch;

a pneumatic cylinder attached to the frame and operably connected to said arm for arcuately pivoting the arm about the axis of said shaft; and a limit switch adapted to be engaged after said arm has pivoted a predetermined amount to cause the pneumatic cylinder to pivot the arm in the opposite direction about the axis;

whereby said hub structure is rotated incrementally about said shaft to permit the staples on the rails to be sequentially fed into the stapler; and means responsive to said first and second limit switches to disable the stapler during said return stroke.

6. The reloading apparatus of claim 5, wherein said follower block, said limit switches, said indexer means and the stapler are pneumatically powered by one pneumatic circuit.

* * * * *